US007716748B2

(12) United States Patent
Dovner

(10) Patent No.: US 7,716,748 B2
(45) Date of Patent: May 18, 2010

(54) BALLISTIC SHIELD

(76) Inventor: Edward R. Dovner, 209 Yelton St., Spindale, NC (US) 28160-1141

( * ) Notice: Subject to any disclaimer, the term of this patent is extended or adjusted under 35 U.S.C. 154(b) by 456 days.

(21) Appl. No.: 11/615,745

(22) Filed: Dec. 22, 2006

(65) Prior Publication Data

US 2007/0283477 A1 Dec. 13, 2007

Related U.S. Application Data

(60) Provisional application No. 60/812,656, filed on Jun. 9, 2006.

(51) Int. Cl.
*A41D 13/00* (2006.01)

(52) U.S. Cl. ..... 2/2.5; 89/36.01

(58) Field of Classification Search ..... 2/455, 2/2.5, 463, 467, 44, 45; 89/36.01, 36.02, 89/36.06, 36.14
See application file for complete search history.

(56) References Cited

U.S. PATENT DOCUMENTS

| | | | | |
|---|---|---|---|---|
| 1,250,197 | A | 12/1917 | Louppe | |
| 1,282,752 | A | 10/1918 | Carrino | |
| 1,466,669 | A | 9/1923 | Martinson | |
| 1,649,996 | A | 11/1927 | Toth | |
| 1,895,197 | A | 1/1933 | Martinson | |
| 2,316,055 | A | 4/1943 | Davey | |
| 3,476,107 | A | 11/1969 | Matt, Jr. et al. | |
| 3,873,998 | A | 4/1975 | Norris et al. | |
| 4,782,735 | A | 11/1988 | Mui et al. | |
| 5,293,807 | A | 3/1994 | Hajdu | |
| 5,392,686 | A | 2/1995 | Sankar | |
| 6,367,943 | B1 | 4/2002 | Tocci et al. | |
| 6,389,949 | B1 | 5/2002 | Carreira | |
| 6,595,101 | B2 | 7/2003 | Baker | |
| 6,807,890 | B1 * | 10/2004 | Fuqua | 89/36.02 |
| 6,886,446 | B1 * | 5/2005 | Baker | 89/36.05 |
| 6,990,887 | B1 | 1/2006 | O'Donnell | |
| 7,124,675 | B1 | 10/2006 | Sand | |
| 7,146,899 | B2 | 12/2006 | Imblum et al. | |
| 7,243,590 | B2 | 7/2007 | McClellan et al. | |

(Continued)

FOREIGN PATENT DOCUMENTS

| | | |
|---|---|---|
| JP | 2004-286257 | 10/2004 |
| JP | 2004-286257 A | 10/2004 |
| JP | 2006-239505 | 12/2006 |
| JP | 2006-329504 | 12/2006 |

OTHER PUBLICATIONS

English Language Abstract for Japanese Publication No. JP2006329504(A).

(Continued)

*Primary Examiner*—Tejash Patel
(74) *Attorney, Agent, or Firm*—Greenberg Traurig, LLP

(57) ABSTRACT

A protective shield having an upper portion, which may be configured to provide ballistic protection to at least a head of a user, and a lower portion, which may be configured to provide ballistic protection to at least a torso of the user. The upper portion may have a width wider than the head of the user. The lower portion may have a width that is greater than the width of the upper portion, and therefore extends laterally beyond the upper portion (forming at least one weapon support region on the protective shield).

20 Claims, 9 Drawing Sheets

U.S. PATENT DOCUMENTS

| | | | | |
|---|---|---|---|---|
| 7,302,880 | B1 * | 12/2007 | Elasic | 89/36.07 |
| 7,424,844 | B2 | 9/2008 | Carter | |
| 2003/0110933 | A1 | 6/2003 | Baker | |
| 2005/0053769 | A1 | 3/2005 | Imblum et al. | |
| 2007/0086190 | A1 | 4/2007 | Kukuk | |
| 2007/0283477 | A1 | 12/2007 | Dovner | |

OTHER PUBLICATIONS

English Language Abstract for Japanese Publication No. JP2006329505(A).

* cited by examiner 800
802
804
POLICE 800
810
812A
812B

BALLISTIC SHIELD

CROSS-REFERENCE TO RELATED APPLICATIONS

This application claims priority to and the benefit of U.S. Provisional Application No. 60/812,656, filed Jun. 9, 2006, entitled "SYSTEMS FOR USE WITH PROTECTIVE GARMENTS", the entirety of which is incorporated herein by reference.

FIELD OF THE INVENTION

The present invention relates to protective shields, and more particularly, to ballistic shields.

For the purposes of the present application the term "ballistic shield" is intended to refer to a shield designed to minimize the chances of a fatality or serious injury in the event of a bullet strike, shrapnel strike, or the like (but not necessarily to be impenetrable to all types of strikes under all conditions).

BACKGROUND OF THE INVENTION

Protective shields are often utilized by law enforcement and military personnel to provide protection against ballistic threats such as firearms. The protective shields available today are reasonably light in weight, and typically provide adequate resistance to projectile penetration. As a result, protective shields have become standard equipment utilized by law enforcement and military personnel in high risk situations.

Among those benefits and improvements that have been disclosed, other objects and advantages of this invention will become apparent from the following description taken in conjunction with the accompanying figures. The figures constitute a part of this specification and include illustrative embodiments of the present invention and illustrate various objects and features thereof.

DETAILED DESCRIPTION OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

In one embodiment, the present invention may provide a protective shield (such as a ballistic shield) that may provide enhanced protection to a user, that may provide the user with increased visibility, and that may reduce exposure of the extremities of the user to potentially lethal projectiles. In one example, the protective shield may include a design configuration that facilitates weapon deployment and/or ambidextrous use of the protective shield.

Figure 1:
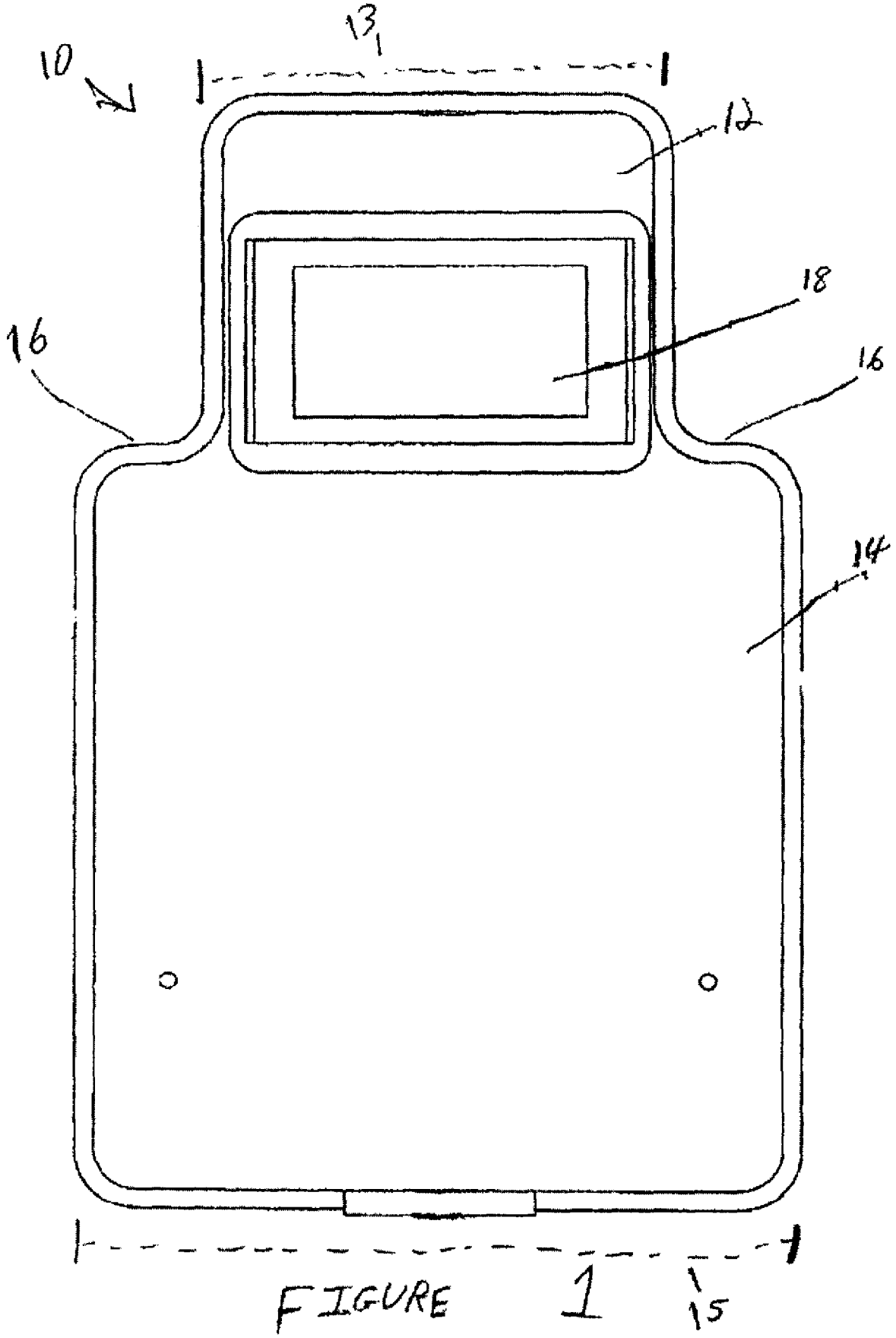
FIG. 1 illustrates a front view of a protective shield in accordance with an embodiment of the present invention.

FIG. 1 illustrates a front view of a protective shield 10 designed in accordance with an embodiment of the present invention. Since the protective shield 10 may be used as a ballistic shield, it may be made of a strong material (e.g., Level IIIA ballistic material), so as to provide frontal protection to the user. The protective shield 10 includes, in an embodiment, an upper portion 12, and a lower portion 14. The upper portion 12 may have a width 13 sufficiently wide to provide coverage and ballistic protection to at least the head of the user. The lower portion 14, likewise, may provide ballistic protection to at least the torso of the user, and may have a width 15 measurably greater than the width 13 of the upper portion 12. With such a design, the lower portion 14 may laterally extend beyond the upper portion 12 to form a flange 16 at each side of an intersection between the upper and lower portions.

As illustrated in FIG. 1, the upper portion 12 of the protective shield 10, may be centrally aligned in relation to the lower portion 14. This configuration facilitates ambidextrous use of shield 10 (e.g., by allowing the user to deploy the shield 10 as well as a firearm, each with either hand). In addition, the firearm may be supported on flange 16 on either side of the upper portion 12, depending on which hand the user utilizes to hold and operate the firearm.

Alternatively, the upper portion 12 of the protective shield 10 may be offset (e.g., aligned with the lower portion 14 along a left or right edge of the protective shield 10) thereby creating a single flange 16 on one side of the protective shield 10. Depending on which side of the shield 10 the flange 16 is located, this configuration customizes the shield 10, so that it may be utilized by a left-handed user or by a right-handed user.

Regardless of the number of flanges 16 on the protective shield 10, the user may deploy the protective shield 10, and may support a firearm barrel on the flange 16, while remaining essentially completely protected behind the shield 10. In fact, when the firearm barrel is supported on the flange 16, the hands and arms of the user may be positioned safely behind the lower portion 14 of the protective shield 10. In other words, the undue risk of harm to the hands and arms of the user from projectiles, which is an inherent danger when reaching around the side of the shield to use a weapon, may be reduced by utilizing the flange 16 as a weapon support. In this example, the user no longer needs to reach around the side of the shield 10 to operate the weapon.

In another embodiment, the protective shield 10 may include a viewport 18 that may provide the user with increased visibility. The user may utilize viewport 18 to view an area or potential threat, while being protected behind shield 10. The viewport 18, in one embodiment, may be located in the upper portion 12 of the shield 10. Alternatively, the viewport may be located in the lower portion 14. In one example, the viewport 18 may include a transparent ballistic material, such as a polycarbonate material, to provide added protection while allowing increased visibility from behind the shield 10. In contrast to conventional viewports, viewport 18 may be relatively large. In one specific example, viewport 18 may measure about 5.5×10 inches in size. The relatively larger size of the viewport 18 may provide the user with additional visibility.

Looking now at FIGS. 2 through 6, which illustrate a rear view of the protective shield 10, there is shown a variety of configurations for accessories and handles arranged in accordance with various embodiments of the present invention.

The protective shield 10, in one embodiment, may include a rear surface 20 upon which a fastening combination 21 may be provided for accepting at least one accessory. In one example, the fastening combination 21 may be a hook and loop fastening combination (e.g., VELCRO). In other examples, the fastening combination may be snaps, snap buttons, tie-cords, or other fasteners, so long as the combination may accept an accessory. Moreover, regardless of the type of fastening combination utilized, the rear surface 20 of protective shield 10 may include one or more fastening combinations 21 of varying size. These fastening combinations 21 may be affixed to the rear surface 20 by, for example, gluing, fastening, etc. It should be appreciated that the individual fasteners and fastening combinations 21 may be disposed anywhere on the rear surface 20, or may be strategically located on the rear surface 20 to accept various accessories.

Each accessory may include a corresponding portion of the fastening combination 21, so that the accessory may be releasably attached to the rear surface 20. For example, if a hook and loop fastening combination is utilized to releasably attach accessories onto the rear surface 20, then the rear surface 20 may include (or be covered with) a loop portion of the fastening combination 21, and the accessories may include the corresponding hook portion. In an alternate embodiment, the rear surface 20 may include (or be covered with) the hook portion, so as to permit the accessories, having the corresponding loop portion, to be placed anywhere upon the rear surface 20.

Potential accessories, components, and mission specific adaptations that may be releasably attached to the rear surface 20, include (but are not limited to): a gun holster 23, a utility bag 26, a forearm pad 28, a laser (with or without a holster), a taser (with or without a holster), a light illuminator, a trauma kit 27, a magazine pouch, a night vision device, an additional ballistic plate insert 50, or any other potential useful components.

Figure 2:
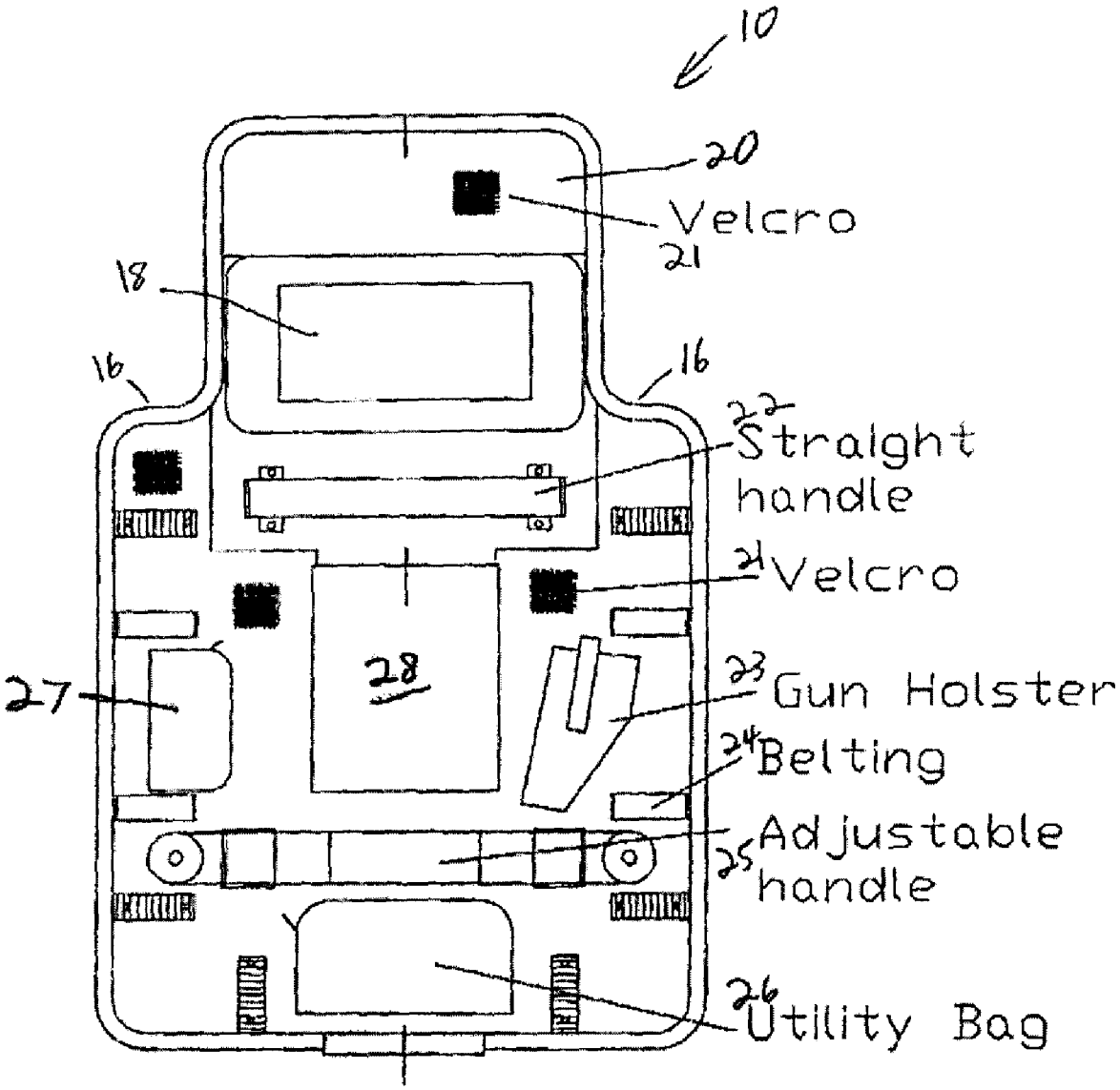
FIGS. 2 through 6 illustrate a rear view of a protective shield configured with various accessories in accordance with various embodiments of the present invention.
Figure 3:
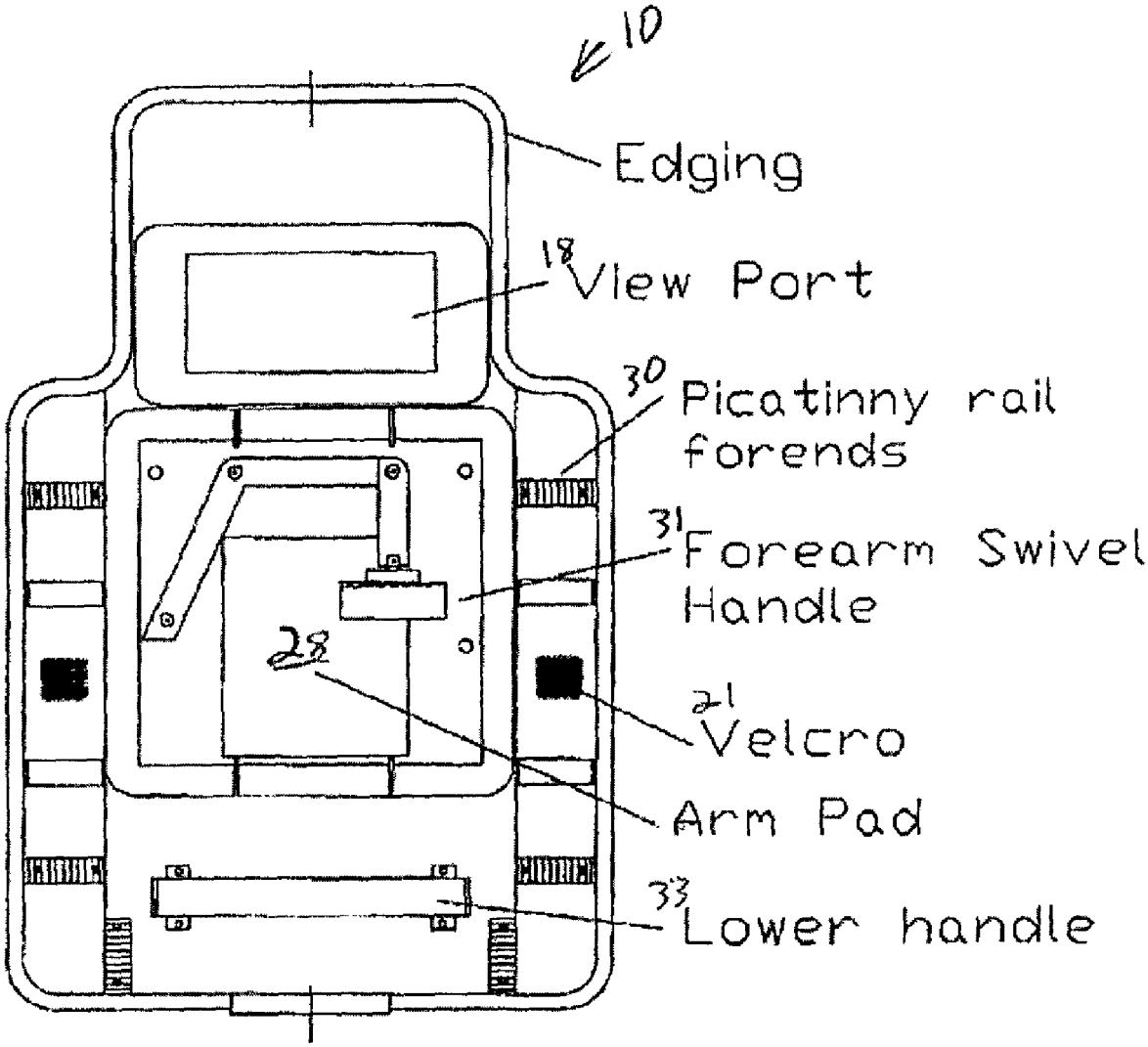
Figure 4:
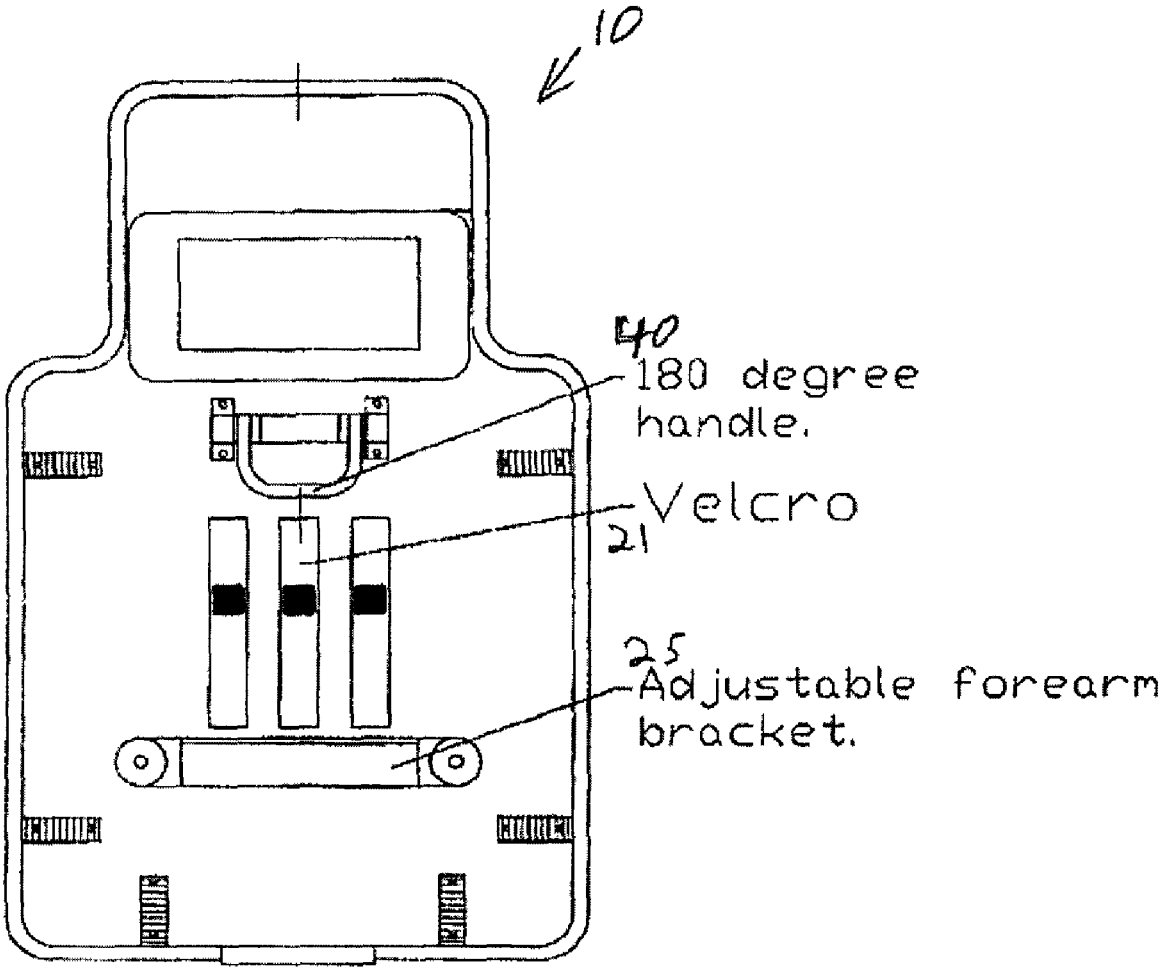
Figure 5:
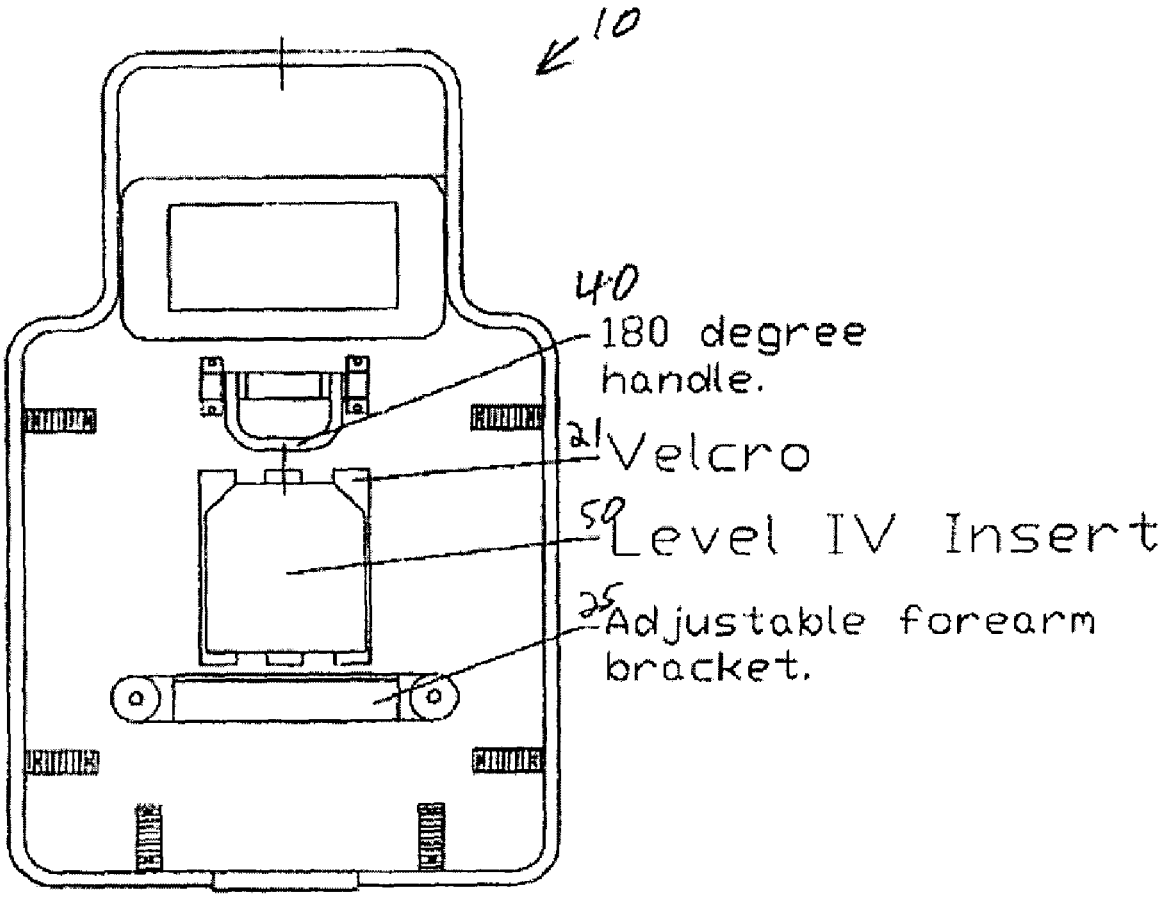
Figure 6:
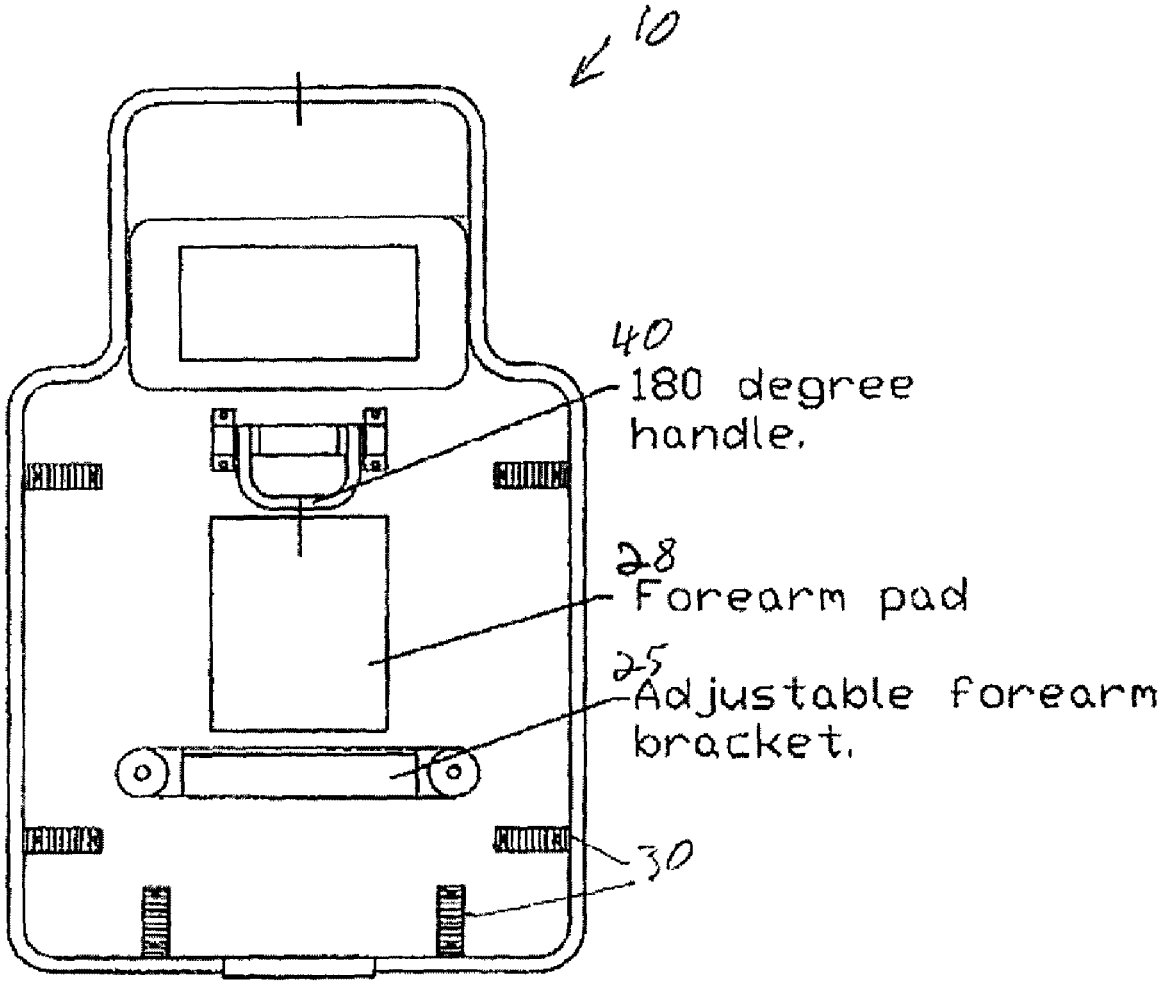

Depending on the mission or task at hand, customized component arrangements may be implemented, and various accessories may be quickly attached, or interchanged on the rear surface 20 of the protective shield 10. For example, as shown in FIGS. 2 and 3, a forearm pad 28 may be included as an accessory on the protective shield 10. Depending on the particular mission, the forearm pad 28 may need to be interchanged with a ballistic insert. Accordingly, as shown in FIG. 4, the forearm pad 28 may be removed to expose the underlying surface having a fastening combination 21. As shown in FIG. 5, a Level IV ballistic insert 50, may then be releasably attached to the fastening combination 21, thereby customizing the protective shield 10 for the particular mission.

The protective shield 10 may also include at least one handle that may be coupled to the rear surface 20. In one example, the handles 22, 25, 31, 33, and 40 (which are depicted in FIGS. 2 through 4) may be affixed to the rear surface 20 by bolting, gluing, or otherwise fastening. These handles may be utilized by the user to carry the shield 10, and to manipulate the position of the shield 10. Moreover, various handle arrangements may be provided, including (for example) straight handles 22 (see FIG. 2), and 33 (see FIG. 3), and an adjustable handle 25 (see FIG. 2). In addition, a handle such as handle 31 (see FIG. 3), may be made to swivel, so as to allow greater maneuverability of the shield 10. Likewise, a handle such as handle 40 (see FIG. 4), may be provided with the ability to have, for example, a 180 degree range of motion.

Figure 7:
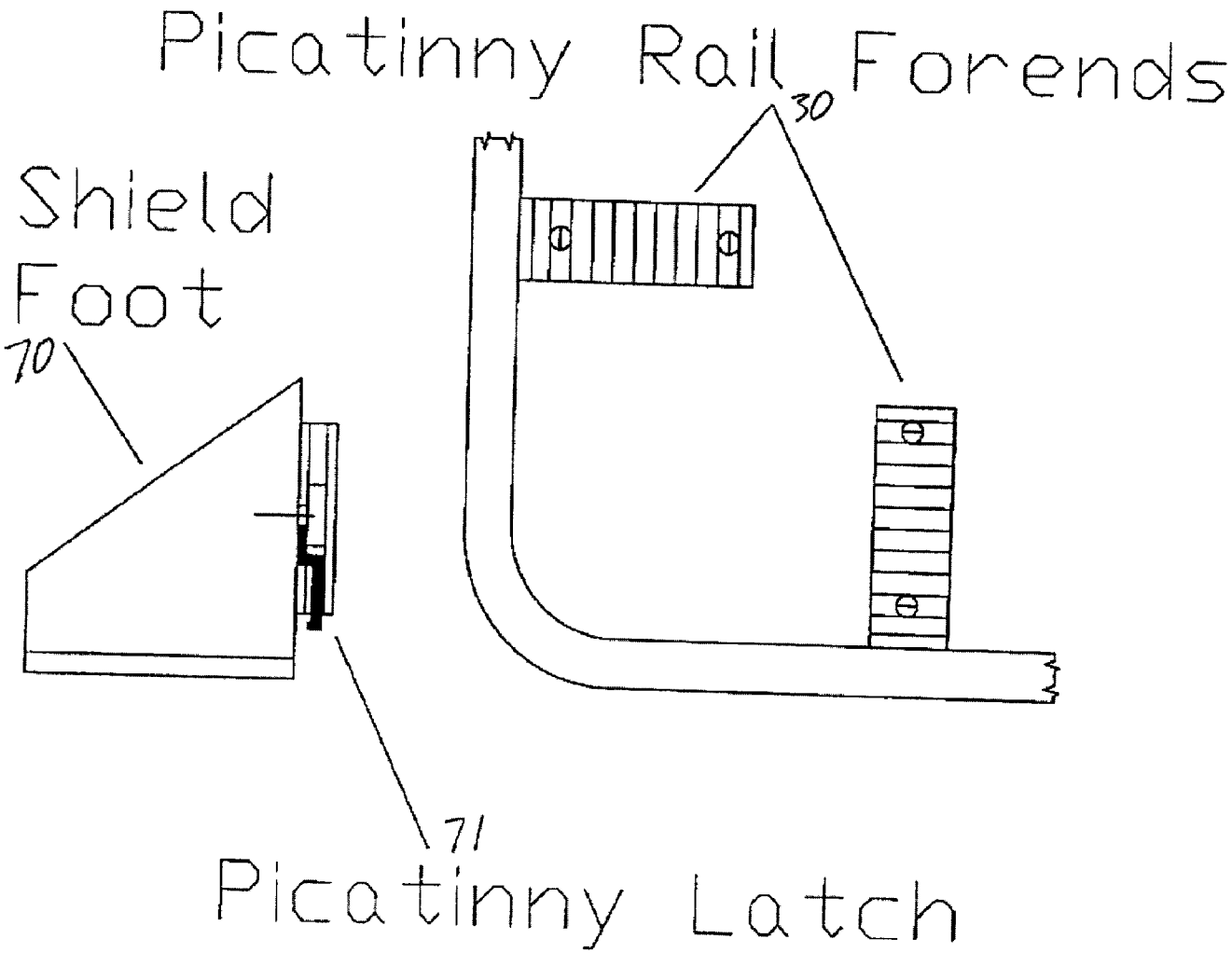
FIG. 7 illustrates a foot and attachment mechanism for use in connection with a protective shield in accordance with an embodiment of the present invention.

The protective shield 10 may also include at least one connection point 30 for accepting an adapter device, fixture, or other hardware assembly thereon. In one example, each connection point 30 may be coupled to the rear surface 20. In a specific example, the connection points 30 may be Picatinny rail forends, which are typically utilized as mounting rails for accepting weapon accessories. As shown in FIG. 7, adapter devices, such as one or more feet 70, may be attached to the connection points 30 (e.g., via a latch 71, or other fastener or clamp). The foot 70 may allow the protective shield 10 to stand unattended (e.g., so that the shield may be deployed on the ground as a fixed barrier to mitigate direct fire of projectiles and ricochets).

In one specific example, a protective shield 10 may have dimensions of about 24×36 inches in size, may weigh about 13 pounds, and may be deployed in and from a vehicle. In normal operation, the user may deploy the protective shield 10 to provide frontal protection. The user may position a firearm (e.g., handgun, long gun) barrel onto the flange 16, and fire at a threat while remaining protected behind the shield 10. The protective shield 10 may be utilized to provide ballistic protection in a similar manner when the user is on the ground in a prone position or on his side. Regardless of the position the user is in, standing, kneeling, or prone position, the flanges 16 may be utilized by the user to deploy a firearm (either a handgun or long gun), while the user remains protected behind the shield 10. In addition, when equipped with adapter devices, such as foot 70, the shield 10 may be configured to stand unattended (e.g., be deployed on the ground as a fixed barrier to mitigate direct fire and/or ricochets).

Of course, the protective shield 10 may be adapted for use by military, law enforcement, school, fire, and/or rescue personnel. Specific uses for the protective shield, may include (but not be limited to): active shooter response, dynamic entries, covert searches, officer and victim rescues, hazardous suspect and vehicle approaches, and crowd control.

Figure 8:
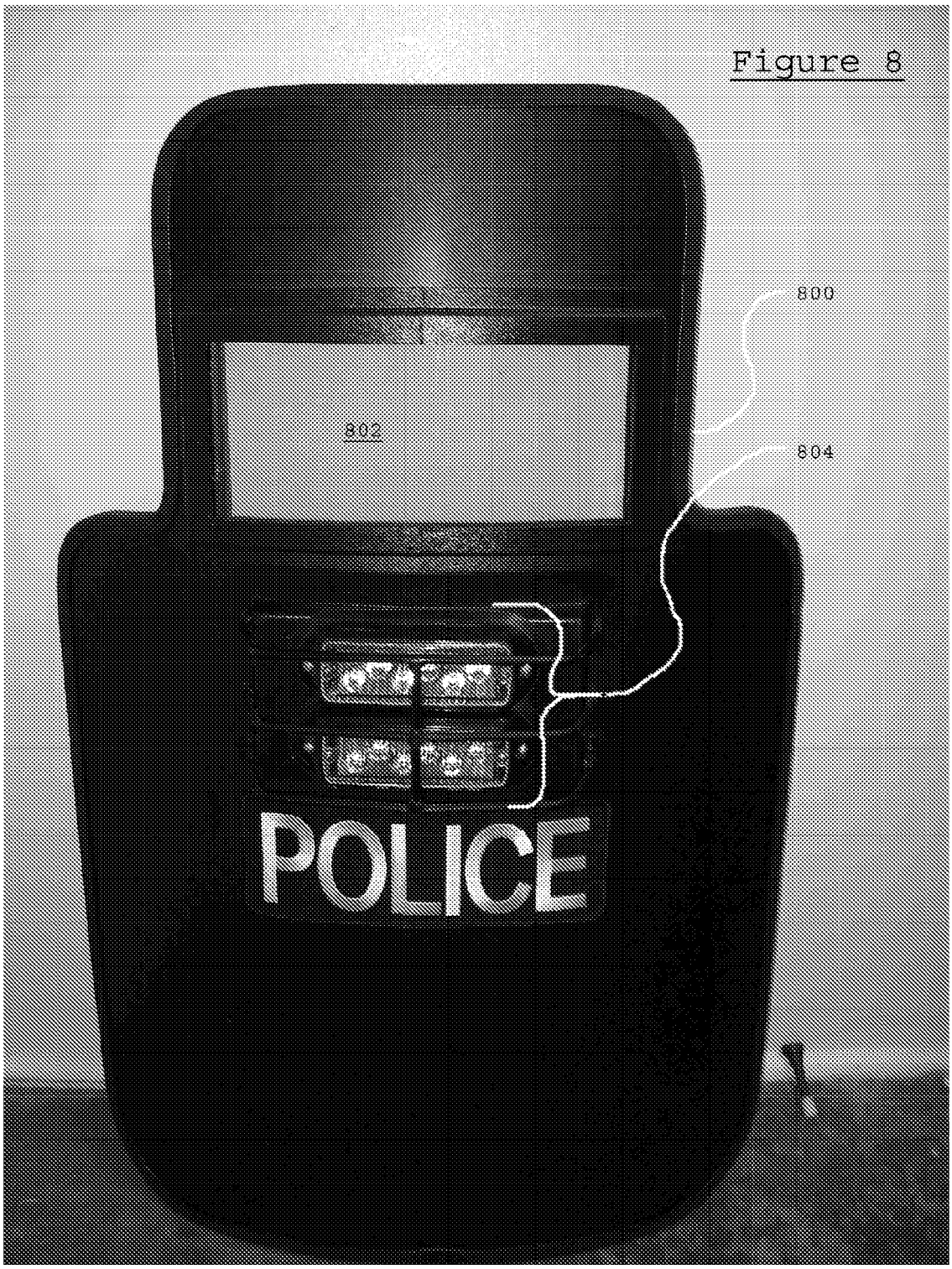
FIG. 8 illustrates a front view of a protective shield in accordance with another embodiment of the present invention.
Figure 9:
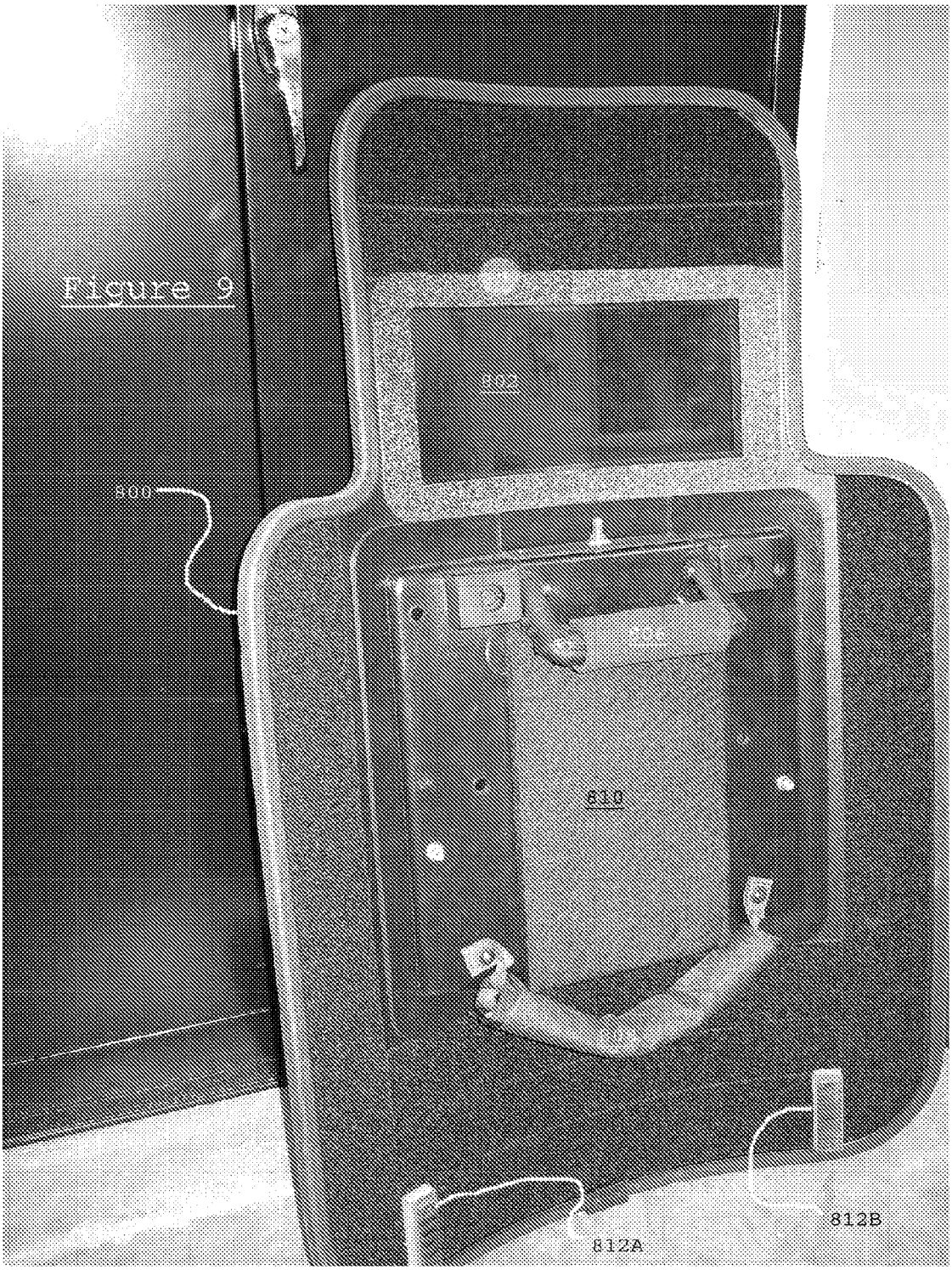
FIG. 9 illustrates a rear view of the protective shield of FIG. 8.

Referring now to FIGS. 8 and 9, a front view (FIG. 8) and a rear view (FIG. 9) of a protective shield in accordance with another embodiment of the present invention is shown.

As seen in these FIGS. 8 and 9, shield 800 may include viewport 802 and lights 804 (in one example Lights 804 may be battery operated and may include one or more spotlights and/or floodlights). Further, handle 806, strap 808 and padding 810 may be provided to allow a user to comfortably grip and manipulate shield 800. Further still, Picatinny rail forends 812A, 812B may be provided for attachment of corresponding feet to hold shield 800 upright (see FIG. 7, showing an example foot 70 and Picatinny rail forends 30 mounted to a shield).

As described above, various embodiments of the present invention relate to a protective shield that may provide ballistic protection to a user. The protective shield may include an upper portion, which may be configured to provide ballistic protection to at least the head of the user. The upper portion may have a width at least as wide as the head of the user. The protective shield may also include a lower portion that may be configured to provide ballistic protection to at least the torso of the user. The lower portion may have a width measurably greater than the width of the upper portion, thereby forming one or more flanges at an intersection between the upper and lower portions on the protective shield for supporting a weapon. The described configuration may reduced exposure of the head, hands, and/or arms (particularly during firearm deployment).

In one example, the protective shield may include a viewport in the upper portion. The viewport may provide the user with increased visibility. In one specific example, the viewport may include a transparent polycarbonate material substantially resistant to ballistic penetration.

Further, the protective shield may include a rear surface upon which a fastening combination, such as a hook and loop fastening combination, may be provided for accepting an accessory. Such accessories include (but are not limited to): a gun holster, a utility bag, a forearm pad, a laser (with or without a holster), a taser (with or without a holster), a light illuminator, a trauma kit, a magazine pouch, a night vision device, an additional ballistic plate insert and/or any other component(s) useful to the user.

The protective shield may also include at least one handle coupled to the rear surface. The handle may be utilized by the user to carry the protective shield, and manipulate its position.

The protective shield may further include a connection point coupled to the rear surface for accepting an adapter device, fixture, or other assembly.

Further, the protective shield may comprise Level IIIA ballistic material.

While a number of embodiments of the present invention have been described, it is understood that these embodiments are illustrative only, and not restrictive, and that many modifications may become apparent to those of ordinary skill in the art. For example, while the shield of the present invention has been described principally as bullet or shrapnel resistant, the shield may also (or instead) be designed to be resistant to sharp and/or blunt weapons (e.g., knives, clubs, etc.). Further, a shield according to the present invention may be designed such that certain components are reusable. Further still, shields of the present invention may comprise any desired materials (e.g., aramid fiber; nylon; rayon; cotton, and/or ceramic). Further still, the flange(s) may be configured to support the barrel of a handgun, rifle or other weapon (in this regard, a flange may have one or more indentations or other features to hold and/or steady a barrel of a weapon). Further still, any steps may be performed in any desired order (and any desired steps may be added and/or any desired steps may be deleted).

What is claimed is:

1. A shield, comprising:

an upper portion configured to provide ballistic protection to at least a head of a user, the upper portion having a width at least as wide as the head of the user;

a lower portion configured to provide ballistic protection to at least a torso of the user, the lower portion having a width that is greater than the width of the upper portion and at least as wide as the torso of the user;

at least one removable foot component;

at least one connection position on the lower portion for attaching the foot component, wherein the foot component permits the shield to stand upright by itself when the foot component is attached thereto, wherein the connection position comprises a Picatinny rail and wherein the foot component comprises a latch for removable attachment of the foot component to the Picatinney rail;

a first flange formed by at least part of an upper edge of the lower portion, wherein the first flange is to the right of the upper portion and;

a second flange formed by at least part of the upper edge of the lower portion, wherein the second flange is to the left of the upper portion;

wherein the upper portion is substantially centered along the upper edge of the lower portion such that the first flange and the second flange are of substantially the same length; and wherein each of the first flange and the second flange are configured to support a barrel of a weapon.

2. The shield of claim 1, further comprising a viewport in the upper portion to provide the user with visibility therethrough.

3. The shield of claim 1, further comprising a rear surface that receives a fastening combination to permit attachment of at least one accessory.

4. The shield of claim 3, wherein the fastening combination is a hook and loop fastening combination.

5. The shield of claim 3, wherein the at least one accessory is selected from the group consisting of: a gun holster, a utility bag, a forearm pad, a laser, a taser, a light illuminator, a trauma kit, a magazine pouch, a night vision device, and a ballistic plate insert.

6. The shield of claim 1, further comprising at least one handle coupled to a rear surface of the shield.

7. The shield of claim 1, wherein the shield comprises Level IIIA ballistic material.

8. The shield of claim 1, further comprising a light mounted to a front surface of the shield.

9. A shield, comprising:

an upper portion configured to provide ballistic protection to at least a head of a user, the upper portion having a width at least as wide as the head of the user;

a lower portion configured to provide ballistic protection to at least a torso of the user, the lower portion having a width that is greater than the width of the upper portion and at least as wide as the torso of the user;

at least one removable foot component;

at least one connection position on the lower portion for attaching the foot component, wherein the foot component permits the shield to stand upright by itself when the foot component is attached thereto, wherein the connection position comprises a Picatinny rail and wherein the foot component comprises a latch for removable attachment of the foot component to the Picatinney rail; and a flange formed by at least part of an upper edge of the lower portion;

wherein the upper portion is offset along the upper edge of the lower portion such that the flange is to one side of the upper portion; and wherein the flange is configured to support a barrel of a weapon.

10. The shield of claim 9, wherein the upper portion is offset along the upper edge to the left of the lower portion such that the flange is to the right of the upper portion.

11. The shield of claim 9, wherein the upper portion is offset along the upper edge to the right of the lower portion such that the flange is to the left of the upper portion.

12. The shield of claim 9, further comprising a viewport in the upper portion to provide the user with visibility therethrough.

13. The shield of claim 9, further comprising a rear surface that receives a fastening combination to permit attachment of at least one accessory.

14. The shield of claim 13, wherein the fastening combination is a hook and loop fastening combination.

15. The shield of claim 13, wherein the at least one accessory is selected from the group consisting of: a gun holster, a utility bag, a forearm pad, a laser, a taser, a light illuminator, a trauma kit, a magazine pouch, a night vision device, and a ballistic plate insert.

16. The shield of claim 9, further comprising at least one handle coupled to a rear surface of the shield.

17. The shield of claim 9, wherein the shield comprises Level IIIA ballistic material.

18. The shield of claim 9, further comprising a light mounted to a front surface of the shield.

19. The shield of claim 1, wherein the weapon is selected from the group consisting of: (a) a handgun; and (b) a rifle.

20. The shield of claim 9, wherein the weapon is selected from the group consisting of: (a) a handgun; and (b) a rifle.

* * * * *